US012584468B2

(12) United States Patent
Hanson

(10) Patent No.: US 12,584,468 B2
(45) Date of Patent: Mar. 24, 2026

(54) FLUID SYSTEM WITH A PROPPANT MIXING PUMP

(71) Applicant: SPM Oil & Gas Inc., Fort Worth, TX (US)

(72) Inventor: Andrew Hanson, Sherwood Park (CA)

(73) Assignee: SPM Oil & Gas Inc., Fort Worth, TX (US)

( * ) Notice: Subject to any disclaimer, the term of this patent is extended or adjusted under 35 U.S.C. 154(b) by 412 days.

(21) Appl. No.: 18/175,986

(22) Filed: Feb. 28, 2023

(65) Prior Publication Data

US 2024/0287976 A1 Aug. 29, 2024

(51) Int. Cl.

| | |
|---|---|
| ***F04B 7/00*** | (2006.01) |
| ***E21B 43/26*** | (2006.01) |
| ***F04B 13/02*** | (2006.01) |
| ***F04B 39/08*** | (2006.01) |

(52) U.S. Cl.

CPC ..... *F04B 7/0065* (2013.01); *E21B 43/2607* (2020.05); *F04B 7/0057* (2013.01); *F04B 13/02* (2013.01); *F04B 39/08* (2013.01)

(58) Field of Classification Search

CPC ..... F04B 39/08; F04B 13/02; F04B 7/0057; F04B 7/0065; E21B 43/2607

USPC ..... 417/442, 503

See application file for complete search history.

(56) References Cited

U.S. PATENT DOCUMENTS

| | | | | | |
|---|---|---|---|---|---|
| 3,161,203 | A * | 12/1964 | Hathorn | E21B 43/2607 | 137/101.25 |
| 3,415,441 | A * | 12/1968 | Theodor | F04B 49/24 | 417/458 |
| 4,432,698 | A * | 2/1984 | Shirakuma | F04B 49/06 | 417/27 |
| 4,673,296 | A * | 6/1987 | Sjogren | B01F 25/60 | 222/137 |
| 4,989,987 | A * | 2/1991 | Berryman | B01F 27/86 | 366/65 |
| 5,537,820 | A * | 7/1996 | Beale | F02G 1/0435 | 60/520 |
| 5,899,272 | A * | 5/1999 | Loree | E21B 43/2605 | 166/280.2 |
| 6,318,977 | B1 * | 11/2001 | Kopko | F04B 39/0016 | 417/493 |
| 6,644,844 | B2 * | 11/2003 | Neal | B01F 33/502 | 366/27 |
| 6,655,362 | B2 * | 12/2003 | Rembold | F02M 59/102 | 123/506 |
| 7,845,413 | B2 * | 12/2010 | Shampine | E21B 43/267 | 415/199.1 |
| 9,091,253 | B2 * | 7/2015 | Stein | F04B 49/24 | |
| 9,335,084 | B2 * | 5/2016 | Lilie | F25D 11/02 | |

(Continued)

*Primary Examiner* — Christopher S Bobish

(57) ABSTRACT

A fluid system may include a first fluid path including a blender configured to mix fluid with proppant. The fluid system may include a second fluid path, fluidly isolated from the blender, including a pump. The fluid system may include a mixing pump configured to receive first fluid containing proppant from the first fluid path and second fluid free of proppant from the second fluid path. The mixing pump may include a cylinder defining a bore. The mixing pump may include a first intake valve configured to control flow of the first fluid, a second intake valve configured to control flow of the second fluid, and an outlet valve configured to control flow of a mixture of the first fluid and the second fluid.

19 Claims, 3 Drawing Sheets

(56) References Cited

U.S. PATENT DOCUMENTS

| | | | | |
|---|---|---|---|---|
| 9,945,216 | B2 | 4/2018 | Ghasripoor et al. | |
| 10,180,135 | B2 * | 1/2019 | Caldwell | F15B 7/006 |
| 10,465,717 | B2 * | 11/2019 | Hoffman | E21B 43/26 |
| 11,746,789 | B2 * | 9/2023 | Pemberton | F16D 1/104 417/423.3 |
| 11,946,468 | B2 * | 4/2024 | Lindholdt | F04B 49/08 |
| 2005/0254980 | A1 * | 11/2005 | Hedman | F04B 49/24 417/283 |
| 2009/0130532 | A1 * | 5/2009 | Yokozawa | B01F 25/4512 417/317 |
| 2014/0023524 | A1 * | 1/2014 | Maass | F25B 49/022 417/63 |
| 2015/0167441 | A1 | 6/2015 | Howell et al. | |
| 2017/0292358 | A1 * | 10/2017 | Elish | F04B 49/22 |
| 2019/0106972 | A1 * | 4/2019 | Sanborn | E21B 43/2607 |

* cited by examiner

FLUID SYSTEM WITH A PROPPANT MIXING PUMP

TECHNICAL FIELD

The present disclosure relates generally to fluid pumps and, for example, to a fluid system with a proppant mixing pump.

BACKGROUND

Hydraulic fracturing is a well stimulation technique that typically involves pumping fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids. The fracturing fluid may include a proppant (e.g., sand) to improve the efficacy of the hydraulic fracturing. For example, the proppant may be added to the fracturing fluid to fill fissures that are generated by the hydraulic fracturing, thereby keeping the fissures open after pumping has stopped. Proppant used in fracturing fluid may accumulate in flow components of a hydraulic fracturing system (referred to as "sand packing"). Moreover, proppant may cause mechanical wear to components, such as pumps, of the hydraulic fracturing system.

The fluid system of the present disclosure solves one or more of the problems set forth above and/or other problems in the art.

SUMMARY

A fluid system may include a first fluid path including a blender configured to mix fluid with proppant. The fluid system may include a second fluid path including a pump, the second fluid path fluidly isolated from the blender. The fluid system may include a mixing pump configured to receive first fluid containing proppant from the first fluid path and second fluid free of proppant from the second fluid path. The mixing pump may include a cylinder defining a bore in fluid communication with a first fluid intake, a second fluid intake, and a fluid outlet. The mixing pump may include a first intake valve configured to control flow of the first fluid containing proppant through the first fluid intake, a second intake valve configured to control flow of the second fluid free of proppant through the second fluid intake, and an outlet valve configured to control flow of a mixture of the first fluid containing proppant and the second fluid free of proppant through the fluid outlet.

A pump may include a cylinder defining a bore in fluid communication with a first fluid intake, a second fluid intake, and a fluid outlet. The pump may include a piston configured to reciprocate within the bore of the cylinder. The pump may include a first intake valve configured to control flow of a first fluid containing proppant through the first fluid intake, the first intake valve configured to open during a downstroke of the piston. The pump may include a second intake valve configured to control flow of a second fluid free of proppant through the second fluid intake, the second intake valve configured to open after, or concurrently with, closing of the first intake valve. The pump may include an outlet valve configured to control flow of a mixture of the first fluid containing proppant and the second fluid free of proppant through the fluid outlet.

A pump system may include a prime mover. The pump system may include a camshaft system mechanically coupled to the prime mover. The pump system may include a pump driven by the prime mover. The pump may include a cylinder defining a bore in fluid communication with a first fluid intake, a second fluid intake, and a fluid outlet. The pump may include a piston configured to reciprocate within the bore of the cylinder. The pump may include a first intake valve configured to control flow of a first fluid containing proppant through the first fluid intake. The camshaft system may be configured to cause the first intake valve to open and to close during a downstroke of the piston. The pump may include a second intake valve configured to control flow of a second fluid free of proppant through the second fluid intake. The camshaft system may be configured to cause the second intake valve to open during the downstroke of the piston after, or concurrently with, closing of the first intake valve, and to close during an upstroke of the piston. The pump may include an outlet valve configured to control flow of a mixture of the first fluid containing proppant and the second fluid free of proppant through the fluid outlet. The camshaft system may be configured to cause the outlet valve to open at least for a duration in which the second intake valve is open.

DETAILED DESCRIPTION

Figure 1:
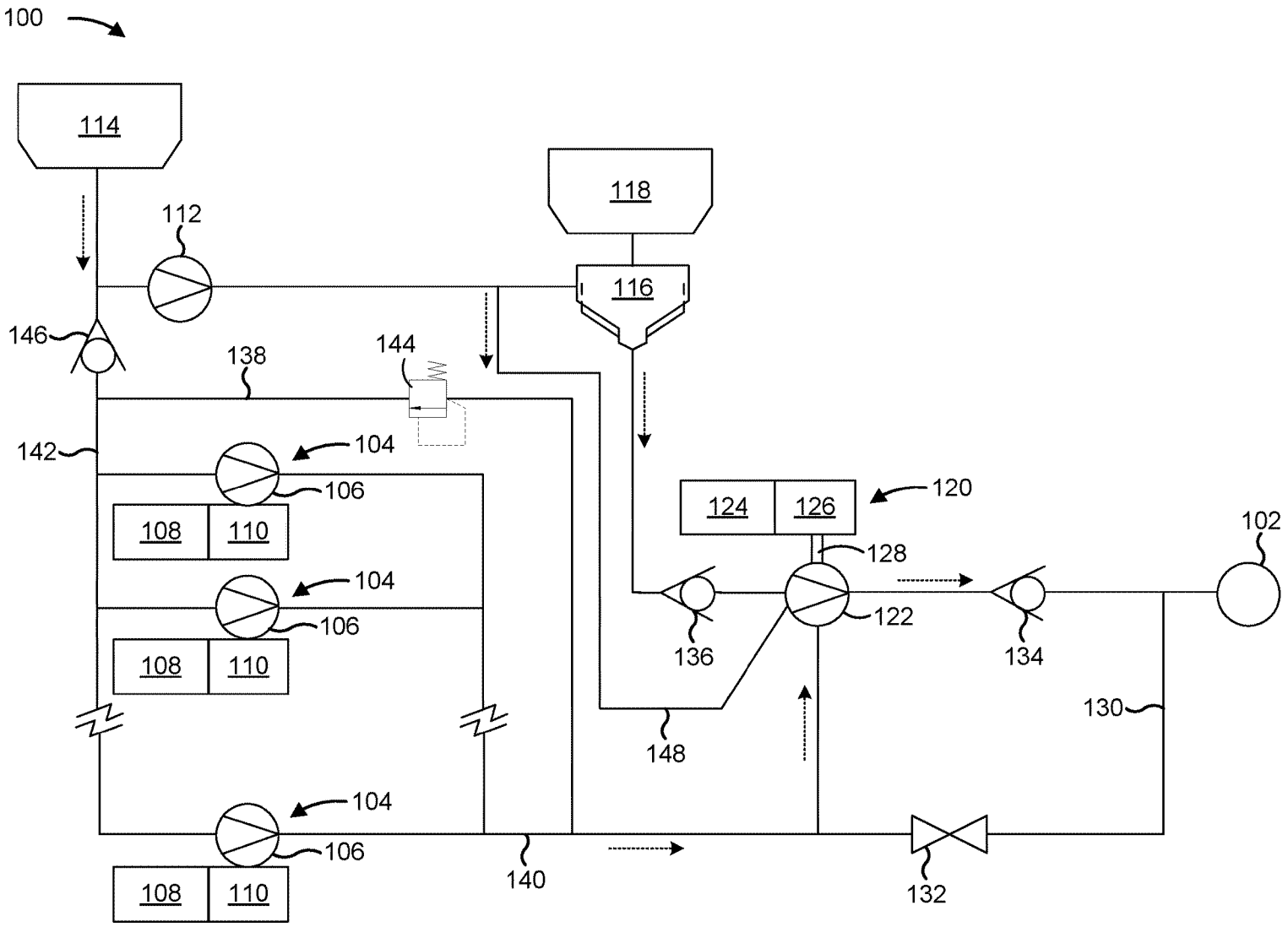
FIG. 1 is a diagram illustrating an example fluid system.

FIG. 1 is a diagram illustrating an example fluid system 100. For example, the fluid system 100 may be a hydraulic fracturing system. In some examples, less equipment, additional equipment, or alternative equipment to the example equipment depicted in FIG. 1 may be used to conduct a hydraulic fracturing process.

The fluid system 100 includes a well 102. For example, in hydraulic fracturing, fracturing fluid is injected at high-pressure into the well 102 and corresponding wellbore in order to hydraulically fracture a rock formation surrounding the wellbore. High-pressure injection of the fracturing fluid may be achieved by one or more pump systems 104 that may be mounted (or housed) on one or more hydraulic fracturing trailers (not shown). Each of the pump systems 104 includes at least one high-pressure pump 106 (e.g., the fluid system 100 includes one or more high-pressure pumps 106). A high-pressure pump 106 may be a hydraulic fracturing pump. A high-pressure pump 106 may include a type of high-volume pump, such as a triplex or quintuplex pump. Additionally, or alternatively, a high-pressure pump 106 may include another type of reciprocating positive-displacement pump or gear pump. Moreover, each of the pump systems 104 may include a prime mover 108 (e.g., an engine) that drives a high-pressure pump 106, of the pump system 104, via a gear box 110. In some examples, the prime mover 108 and the high-pressure pump 106 may share a housing. Multiple high-pressure pumps 106 may be in fluid communication with a manifold (not shown). The manifold combines fracturing fluid received from the high-pressure pumps 106.

The fluid system 100 may also include one or more low-pressure pumps 112. A low-pressure pump 112 may include a reciprocating pump, a gear pump, or the like. The high-pressure pump(s) 106 may be configured to pressurize fluid to a greater pressure (e.g., a pressure greater than 8,000 psi) than a pressure of fluid pressurized by the low-pressure pump(s) 112 (e.g., a pressure less than 300 psi). The high-pressure pump(s) 106 and the low-pressure pump(s) 112 receive fluid (e.g., water) from one or more tanks 114. As shown, the tank 114 may commonly supply fluid to the high-pressure pump(s) 106 and the low-pressure pump(s) 112. In some implementations, separate tanks 114 may respectively supply fluid to the high-pressure pump(s) 106 and the low-pressure pump(s) 112. In some examples, the fluid system 100 may receive fluid from fluid pits, fluid trucks, and/or fluid lines, among other examples.

The low-pressure pump(s) 112 may be configured to direct fluid to a blender 116 for mixing with proppant. For example, the blender 116 combines proppant received from a proppant storage unit 118 with the fluid received from the low-pressure pump(s) 112. In some examples, the proppant storage unit 118 may include a dump truck, a truck with a trailer, one or more silos, or other types of containers. In some implementations, the low-pressure pump(s) 112 may be eliminated from the fluid system 100, and the fluid may be directed to the blender 116 by gravity (e.g., the tank(s) 114 may be elevated relative to the blender 116), by pressurizing the tank(s) 114, or the like.

The fluid system 100 includes at least one mixing pump system 120. The mixing pump system 120 includes a mixing pump 122. The mixing pump 122 is downstream from the low-pressure pump(s) 112 and the blender 116 and downstream from the high-pressure pump(s) 106. For example, the mixing pump 122 may be configured to receive first fluid containing proppant (e.g., hydraulic fracturing fluid, such as water, mixed with proppant, such as sand) from the blender 116 and second fluid free of proppant (e.g., pure hydraulic fracturing fluid, such as water) from the high-pressure pump(s) 106. As an example, the fluid system 100 may include a first fluid path to the mixing pump 122 that includes the low-pressure pump(s) 112 and the blender 116, and the fluid system 100 may include a second fluid path to the mixing pump 122 that includes the high-pressure pump(s) 106. The second fluid path may be fluidly isolated from the blender 116. As described herein, the second fluid may have a greater pressure at the mixing pump 122 than a pressure of the first fluid at the mixing pump 122. The second fluid may be considered free of proppant if the second fluid contains zero proppant or if the second fluid is substantially free of proppant, such as a proppant concentration of less than 1%.

The mixing pump 122 may be configured to mix the first fluid and the second fluid and to discharge a mixture of the first fluid and the second fluid to the well 102. Thus, proppant is first introduced to a pump of the fluid system 100 at the mixing pump 122, and neither the high-pressure pump(s) 106 nor the low-pressure pump(s) 112 handle fluid containing proppant. In this way, the fluid system 100 protects the high-pressure pump(s) 106 and the low-pressure pump(s) 112 from mechanical wear that may otherwise occur due to proppant.

The mixing pump system 120 may include a prime mover 124 and a gear box 126, in a similar manner as described above. The mixing pump 122 may include a type of reciprocating positive-displacement pump. The mixing pump system 120 may include a camshaft system 128, mechanically coupled to the prime mover 124 (e.g., via the gear box 126), configured to control a movement of one or more pistons and/or valves of the mixing pump 122, as described in connection with FIGS. 2-3. For example, the prime mover 124 may be configured to drive the camshaft system 128, which may be mechanically coupled to one or more pistons of the mixing pump 122 and/or one or more valves of the mixing pump 122. The camshaft system 128 may include only a single camshaft or multiple camshafts mechanically coupled to each other. In one example, the camshaft system 128 may include a first camshaft configured to drive one or more first pistons and/or one or more first valves of the mixing pump 122, and a second camshaft, coupled to the first camshaft, configured to drive one or more second pistons and/or one or more second valves of the mixing pump 122. Alternatively, a crankshaft may be mechanically coupled to the prime mover 124 (e.g., via the gear box 126), and the crankshaft may be configured to control a movement of the one or more pistons of the mixing pump 122. Here, the camshaft system 128 may be coupled to the crankshaft, and the camshaft system 128 may be configured to control a movement of the valves of the mixing pump 122.

In some implementations, the fluid system 100 may include a bypass line 130 configured to direct fluid discharged from the high-pressure pump(s) 106 to the well 102 bypassing the mixing pump 122. For example, a first portion of fluid discharged from the high-pressure pump(s) 106 may be directed to the mixing pump 122, and a second portion of fluid discharged from the high-pressure pump(s) 106 may be directed to the well 102 via the bypass line 130. The fluid system 100 may include a control valve 132 in the bypass line 130. The control valve 132 may be configured to permit fluid discharged from the high-pressure pump(s) 106 to flow to the well 102 to compensate for fluctuations in flow from the mixing pump 122. For example, the control valve 132 may be configured to open to permit fluid discharged from the high-pressure pump(s) 106 to flow to the well 102 when a pressure upstream of the control valve 132 exceeds a threshold, which may occur in coordination with discharge pulses of the mixing pump 122 such that a steady flow of fluid is directed to the well 102. In some implementations, the mixing pump 122 may include multiple cylinders that discharge fluid at different times, in coordination, to thereby produce a steady flow of fluid (in which case, the bypass line 130 and control valve 132 may be eliminated).

The fluid system 100 may include a check valve 134 downstream of the mixing pump 122 between the mixing pump 122 and the well 102. The check valve 134 may be configured to allow fluid flow in a forward direction from the mixing pump 122 to the well 102 and to prevent fluid flow in a reverse direction to the mixing pump 122. For example, the check valve 134 may prevent fluid flow from the bypass line 130 in the reverse direction to the mixing pump 122. Additionally, or alternatively, the fluid system 100 may include a check valve 136 upstream of the mixing pump 122 between the mixing pump 122 and the blender 116. The check valve 136 may be configured to allow fluid flow in a forward direction from the blender 116 to the mixing pump 122 and to prevent fluid flow in a reverse direction to the blender 116. For example, the check valve 136 may prevent fluid flow from the high-pressure pump(s) 106 to the blender via the mixing pump 122.

The fluid system 100 may include a pressure relief line 138 that fluidly connects a discharge line 140 from the high-pressure pump(s) 106 and an intake line 142 to the high-pressure pump(s) 106. For example, the pressure relief line 138 may be configured to direct fluid discharged from the high-pressure pump(s) 106 to a location upstream of the high-pressure pump(s) 106. The fluid system 100 may include a pressure relief valve 144 in the pressure relief line 138. The pressure relief valve 144 may be configured to open to permit fluid discharged from the high-pressure pump(s) 106 to flow to the intake line 142 when a pressure upstream of the pressure relief valve 144 exceeds a threshold. In this way, excess pressure may be diverted from the mixing pump 122 in the event of component failure.

The fluid system 100 may include a check valve 146 between the pressure relief line 138 and the low-pressure pump(s) 112 or the tank 114. The check valve 146 may be configured to allow fluid flow in a forward direction from the tank 114 to the high-pressure pump(s) 106 and to prevent fluid flow in a reverse direction from the pressure relief line 138 to the low-pressure pump(s) 112 or the tank 114.

The fluid system 100 may include a fluid line 148 configured to direct fluid discharged from the low-pressure pump(s) 112 (or fluid directly from the tank(s) 114) to the mixing pump 122 bypassing the blender 116 (e.g., the fluid line 148 may branch from the first fluid path). Thus, fluid in the fluid line 148 may be free of proppant. In this way, the mixing pump 122 may receive fluid containing proppant via the blender 116 and/or fluid free of proppant via the fluid line 148 (e.g., for periods of proppant-free operation of the mixing pump 122).

As indicated above, FIG. 1 is provided as an example. Other examples may differ from what is described with regard to FIG. 1.

Figure 2:
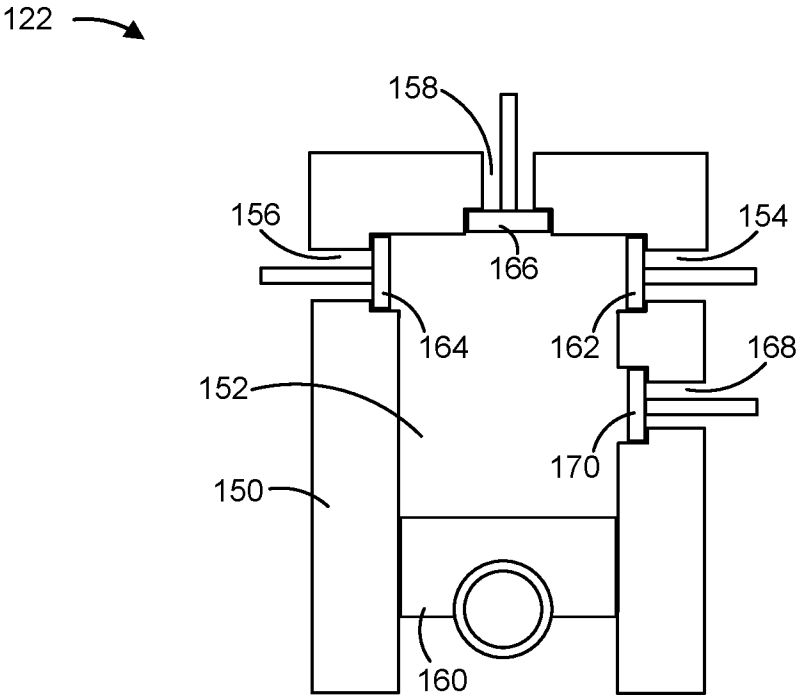
FIG. 2 is a diagram illustrating a sectional view of an example of a mixing pump.

FIG. 2 is a diagram illustrating a sectional view of an example of the mixing pump 122. As shown, the mixing pump 122 may include a piston pump. In some examples, the mixing pump 122 may be another type of reciprocating displacement pump. As used herein, the term "piston" may include a plunger.

The mixing pump 122 may include a cylinder 150. The cylinder 150 may define a bore 152 that is in fluid communication with a first fluid intake 154, a second fluid intake 156, and a fluid outlet 158. For example, the first fluid intake 154, the second fluid intake 156, and the fluid outlet 158 may extend through the cylinder 150 to the bore 152.

The mixing pump 122 may include a piston 160 configured to reciprocate within the bore 152 of the cylinder 150 (e.g., between a top dead center (TDC) position and a bottom dead center (BDC) position, with a middle position of the piston 160 equidistant from the TDC position and the BDC position). The mixing pump 122 may be a driven pump. The piston 160 may be configured to be driven by the camshaft system 128 (e.g., via a connecting rod, not shown), described in connection with FIG. 1. For example, a configuration of the camshaft system 128 may provide a timing for reciprocation of the piston 160. Alternatively, the piston 160 may be configured to be driven by a crankshaft, as described above.

The mixing pump 122 may include a first intake valve 162 configured to control a flow of fluid through the first fluid intake 154 to the bore 152. For example, the first fluid intake 154 may be fluidly connected to the low-pressure pump(s) 112 and the blender 116 (e.g., the first fluid intake 154 may be fluidly connected to the first fluid path of the fluid system 100), described in connection with FIG. 1. Thus, the first intake valve 162 may be configured to control a flow of the first fluid containing proppant through the first fluid intake 154 to the bore 152.

The mixing pump 122 may include a second intake valve 164 configured to control a flow of fluid through the second fluid intake 156 to the bore 152. For example, the second fluid intake 156 may be fluidly connected to the high-pressure pump(s) 106 (e.g., the second fluid intake 156 may be fluidly connected to the second fluid path of the fluid system 100), described in connection with FIG. 1. Thus, the second intake valve 164 may be configured to control a flow of the second fluid free of proppant through the second fluid intake 156 to the bore 152.

FIG. 2 shows the first fluid intake 154 and the first intake valve 162 on opposing sides of the cylinder 150 from the second fluid intake 156 and the second intake valve 164 in a coaxial arrangement. In some implementations, the second fluid intake 156 and the second intake valve 164 may be located lower on the cylinder 150 (e.g., further from the fluid outlet 158) than the first fluid intake 154 and the first intake valve 162. Moreover, the second fluid intake 156 may be angled upwards (e.g., toward the fluid outlet 158). In this way, the second fluid free of proppant may flush the first fluid containing proppant from the cylinder 150, rather than mixing with the first fluid in the cylinder 150, thereby reducing or preventing proppant accumulation in moving parts of the mixing pump 122.

The mixing pump 122 may include an outlet valve 166 configured to control a flow of fluid through the fluid outlet 158 from the bore 152. For example, the fluid outlet 158 may be fluidly connected to the well 102 (e.g., via the check valve 134), described in connection with FIG. 1. Thus, the outlet valve 166 may be configured to control a flow of a mixture of the first fluid containing proppant and the second fluid free of proppant through the fluid outlet 158 from the bore 152. A configuration of the camshaft system 128 may provide timings of opening and closing of the first intake valve 162, the second intake valve 164, and the outlet valve 166, as described further in connection with FIG. 3.

The mixing pump 122 may include a third fluid intake 168 that is in fluid communication with the bore 152. The mixing pump 122 may include a third intake valve 170 configured to control a flow of fluid through the third fluid intake 168 to the bore 152. For example, the third fluid intake 168 may be fluidly connected to the fluid line 148, which bypasses the blender 116, as described in connection with FIG. 1. Thus, the third intake valve 170 may be configured to control a flow of low-pressure fluid free of proppant through the third fluid intake 168 to the bore 152.

In some implementations, the mixing pump 122 may include multiple cylinders 150, each associated with a respective piston 160. For example, the mixing pump 122 may include a first cylinder 150 and a first piston 160 configured to reciprocate within the first cylinder 150, and a second cylinder 150 and a second piston 160 configured to reciprocate within the second cylinder 150. The first piston 160 may be configured to reciprocate according to a first timing and the second piston 160 may be configured to reciprocate according to a second timing (e.g., the first piston 160 and the second piston 160 may be sequenced). For example, a configuration of the camshaft system 128 (or a crankshaft) may provide the first timing and the second timing. The first timing may be different from the second timing, such that the first cylinder 150 and the second cylinder 150 discharge fluid at different times to thereby produce a steady flow of fluid from the mixing pump 122, as described herein.

As indicated above, FIG. 2 is provided as an example. Other examples may differ from what is described with regard to FIG. 2.

Figure 3:
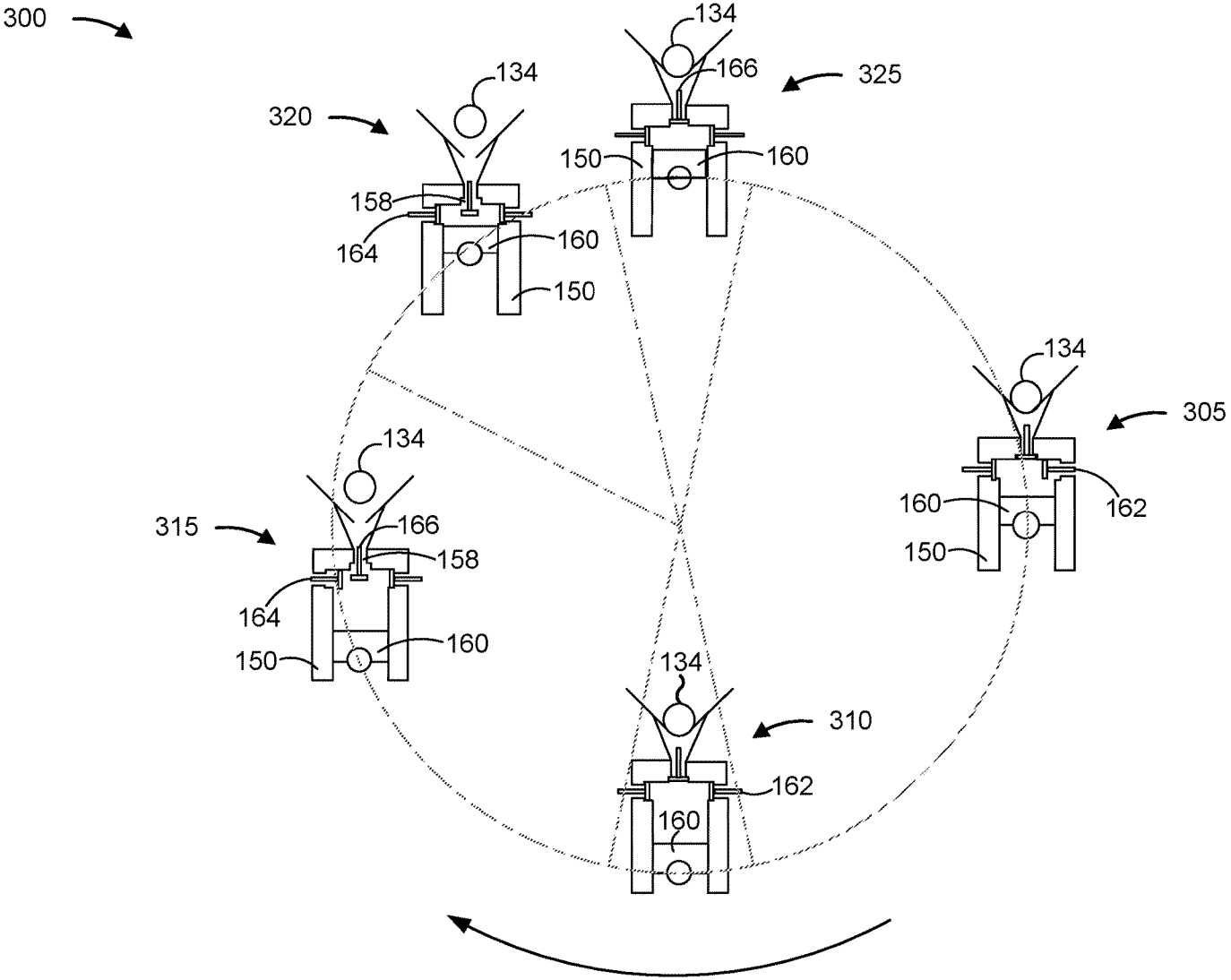
FIG. 3 is a diagram illustrating an example associated with operation of a mixing pump.

FIG. 3 is a diagram illustrating an example 300 associated with operation of the mixing pump 122. FIG. 3 also shows a response of the check valve 134 to operation of the mixing pump 122. In particular, FIG. 3 shows timings of opening and closing of the valves 162, 164, and 166 in relation to reciprocation of the piston 160 during a cycle of the mixing pump 122. For illustration purposes, the mixing pump 122 is shown in FIG. 3 without the third fluid intake 168 and the third intake valve 170. However, the mixing pump 122 of example 300 may include the third fluid intake 168 and the third intake valve 170. Example 300 relates to two-stroke operation of the mixing pump 122.

As shown by reference number 305, the first intake valve 162 may be configured to open during a downstroke of the piston 160. "Downstroke" may refer to a stroke of the piston 160 that increases a fluid volume in the cylinder 150 (e.g., a stroke away from the fluid outlet 158). For example, the first intake valve 162 may be configured to open during the downstroke of the piston 160 between the TDC position and the middle position of the piston 160. As an example, at a beginning of the downstroke, the first intake valve 162 may open to cause the first fluid containing proppant (e.g., low-pressure fluid) to enter the cylinder 150. The third intake valve 170 may open in addition to, or alternatively to, opening of the first intake valve 162 (e.g., according to the same timing used for the first intake valve 162). As described herein, a configuration of the camshaft system 128 may dictate a timing of an opening of the first intake valve 162 and/or the third intake valve 170.

As shown by reference number 310, the first intake valve 162 may be configured to subsequently close during the downstroke of the piston 160. For example, the first intake valve 162 may be configured to close during the downstroke at approximately (e.g., within ±10% of a stroke length) the middle position of the piston 160. As an example, at approximately a middle of the downstroke, the first intake valve 162 may close. Alternatively, the first intake valve 162 may be configured to close during an upstroke of the piston 160. "Upstroke" may refer to a stroke of the piston 160 that decreases a fluid volume in the cylinder 150 (e.g., a stroke toward the fluid outlet 158). The third intake valve 170 may close in addition to, or alternatively to, closing of the first intake valve 162 (e.g., according to the same timing used for the first intake valve 162). As described herein, a configuration of the camshaft system 128 may dictate a timing of a closing of the first intake valve 162 and/or the third intake valve 170.

As shown by reference number 315, the second intake valve 164 may be configured to open after (e.g., immediately after) closing of the first intake valve 162 or concurrently with closing of the first intake valve 162 (and/or the third intake valve 170). For example, the second intake valve 164 may be configured to open during the downstroke of the piston 160 (e.g., at approximately a middle of the downstroke) or during the upstroke of the piston 160, depending on when the first intake valve 162 closes (and/or when the third intake valve 170 closes). Moreover, the outlet valve 166 may be configured to open with (e.g., at the same time as) opening of the second intake valve 164, configured to open while the second intake valve 164 is open, or configured to open after closing of the second intake valve 164. For example, the outlet valve 166 may be configured to open at least for a duration in which the second intake valve 164 is open. Thus, opening of the second intake valve 164 may cause the second fluid free of proppant to enter the cylinder 150 and to expel both the first fluid containing proppant and the second fluid free of proppant from the cylinder 150 via the fluid outlet 158 (e.g., when the outlet valve 166 is open). As an example, the second fluid free of proppant (e.g., high-pressure fluid) may expel the first fluid containing proppant (e.g., low-pressure fluid) from an end of the downstroke until near a top of an upstroke of the piston 160. As described herein, a configuration of the camshaft system 128 may dictate a timing of an opening of the second intake valve 164 and an opening of the outlet valve 166.

As shown by reference number 320, the second intake valve 164 may be configured to close during the upstroke of the piston 160. For example, the second intake valve 164 may be configured to close during the upstroke of the piston 160 between the middle position and the TDC position of the piston 160. As an example, near a top of the upstroke, the second intake valve 164 may close, and the piston 160 (e.g., in a final closing stroke) may expel a remainder of fluid from the cylinder 150 via the fluid outlet 158. Alternatively, the second intake valve 164 may be configured to close during the downstroke of the piston 160 (e.g., the first intake valve 162 may open and then close during the downstroke of the piston 160, and thereafter, the second intake valve 164 may open and then close during the downstroke of the piston 160). As described herein, a configuration of the camshaft system 128 may dictate a timing of a closing of the second intake valve 164.

As shown by reference number 325, the outlet valve 166 may be configured to close after closing of the second intake valve 164. For example, the outlet valve 166 may be configured to open concurrently with opening of the second intake valve 164, and the outlet valve 166 may be configured to close after closing of the second intake valve 164 and before opening of the first intake valve 162 in a subsequent cycle. Thus, in the subsequent cycle, the first fluid containing proppant (e.g., low-pressure fluid) may enter the cylinder 150 during a downstroke, as described above, due to the vacuum created by closing of the outlet valve 166. As described herein, a configuration of the camshaft system 128 may dictate a timing of a closing of the outlet valve 166.

In some implementations, four-stroke operation of the mixing pump 122 may be employed. In the four-stroke operation, the first intake valve 162 may be configured to open during a first downstroke of the piston 160. Additionally, or alternatively, the third intake valve 170 may be configured to open during the first downstroke of the piston 160. Thus, the first downstroke may draw low-pressure fluid (e.g., the first fluid containing proppant) into the cylinder 150. The first intake valve 162 (and/or the third intake valve 170) may close at an end (or near the end) of the first downstroke.

The outlet valve 166 may be configured to open, after closing of the first intake valve 162 (and/or the third intake valve 170), in a first upstroke of the piston 160. The first upstroke of the piston 160 may pressurize the low-pressure fluid (e.g., the first fluid containing proppant) and cause the fluid to exit the cylinder via the fluid outlet 158, thereby causing the check valve 134 to open. The outlet valve 166 may be configured to close at an end (or near the end) of the first upstroke. Alternatively, the outlet valve 166 may be configured to remain open at the end of the first upstroke.

The second intake valve 164 may be configured to open during a second downstroke of the piston 160. Thus, the second fluid free of proppant (e.g., high-pressure fluid) may enter the cylinder 150 during the second downstroke of the piston 160. If the outlet valve 166 has remained open, then the second fluid free of proppant may exit the cylinder 150 via the fluid outlet 158. The second intake valve 164 may be configured to close at an end (or near the end) of the second downstroke. Alternatively, the second intake valve 164 may be configured to remain open at the end of the second downstroke.

If not already open, the outlet valve 166 may be configured to open in a second upstroke of the piston 160. The second upstroke of the piston 160 may expel the second fluid free of proppant from the cylinder 150 via the fluid outlet 158. The outlet valve 166 may be configured to close at an end (or near the end) of the second upstroke. If not closed already, the second intake valve 164 may be configured to close at the end (or near the end) of the second upstroke (e.g., prior to closing of the outlet valve 166). In the four-stroke operation, the second fluid containing proppant may mix with the first fluid free of proppant downstream of the mixing pump 122.

As indicated above, FIG. 3 is provided as an example. Other examples may differ from what is described with regard to FIG. 3.

INDUSTRIAL APPLICABILITY

The fluid system described herein may be used in any application that utilizes fluid mixed with proppant. For example, the fluid system may be used with a hydraulic fracturing system that pressurizes fluid for hydraulic fracturing using fluid pumps. The fluid system is useful for reducing or preventing the accumulation of proppant in the fluid pumps that pressurize the fluid and/or useful for reducing mechanical wear to the fluid pumps due to the abrasiveness of proppant. For example, the fluid system may employ a mixing pump, as described herein, downstream of the fluid pumps that pressurize the fluid. The fluid pressurized by the fluid pumps may be free of proppant, and proppant may be added to the fluid downstream of the fluid pumps. Accordingly, proppant is first introduced to a pump of the fluid system at the mixing pump, and the handling of fluid containing proppant may be eliminated from the fluid pumps that pressurize the fluid. In this way, the fluid system protects the fluid pumps that pressurize the fluid from proppant accumulation and/or from wear due to proppant, thereby extending a useful life of the fluid pumps, improving an uptime of the fluid pumps, and/or improving an uptime of the fluid system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A fluid system, comprising:

a first fluid path including a first pump and a blender configured to mix fluid with proppant;

a second fluid path including a second pump, the second fluid path fluidly isolated from the blender; and a mixing pump configured to receive first fluid containing proppant from the first fluid path, receive second fluid free of proppant from the second fluid path, and mix the first fluid and the second fluid downstream of the second pump, the mixing pump comprising:

a cylinder defining a bore in fluid communication with a first fluid intake, a second fluid intake, and a fluid outlet;

a first intake valve configured to control flow of the first fluid containing proppant through the first fluid intake, wherein the first intake valve is configured to open and to close during a downstroke of a piston configured to reciprocate within the bore of the cylinder;

a second intake valve configured to control flow of the second fluid free of proppant through the second fluid intake, wherein the second intake valve is configured to open during the downstroke of the piston after, or concurrently with, closing of the first intake valve, and to close during an upstroke of the piston; and an outlet valve configured to control flow of a mixture of the first fluid containing proppant and the second fluid free of proppant through the fluid outlet, wherein the outlet valve is configured to open at least for a duration in which the second intake valve is open.

2. The fluid system of claim 1, wherein the second fluid free of proppant has a greater pressure at the mixing pump than a pressure of the first fluid containing proppant at the mixing pump.

3. The fluid system of claim 1, further comprising: a prime mover configured to drive a camshaft system that is mechanically coupled to the piston configured to reciprocate within the bore of the cylinder.

4. The fluid system of claim 3, wherein a configuration of the camshaft system provides timings of opening and closing of the first intake valve, the second intake valve, and the outlet valve.

5. The fluid system of claim 1, wherein the outlet valve is configured to open with opening of the second intake valve.

6. The fluid system of claim 1, wherein a third fluid intake in the cylinder is in fluid communication with the bore, and wherein the fluid system further comprises:

a fluid line, bypassing the blender, configured to direct fluid free of proppant to the mixing pump; and a third intake valve configured to control flow of the fluid free of proppant through the third fluid intake.

7. The fluid system of claim 1, further comprising:

a pressure relief line configured to direct the second fluid from a discharge line of the second pump to an intake line to the second pump; and a pressure relief valve in the pressure relief line.

8. A pump, comprising:

a cylinder defining a bore in fluid communication with a first fluid intake, a second fluid intake, and a fluid outlet;

a piston configured to reciprocate within the bore of the cylinder;

a first intake valve configured to control flow of a first fluid containing proppant through the first fluid intake, the first intake valve configured to open during a downstroke of the piston to cause the first fluid containing proppant to enter the cylinder;

a second intake valve configured to control flow of a second fluid free of proppant through the second fluid intake, the second intake valve configured to open after, or concurrently with, closing of the first intake valve to cause the second fluid free of proppant to enter the cylinder and to expel the first fluid containing proppant and the second fluid free of proppant from the cylinder via the fluid outlet; and an outlet valve configured to control flow of a mixture of the first fluid containing proppant and the second fluid free of proppant through the fluid outlet.

9. The pump of claim 8, wherein the second fluid free of proppant has a greater pressure than a pressure of the first fluid containing proppant.

10. The pump of claim 8, wherein the piston is configured to be driven by a camshaft system, and a configuration of the camshaft system provides timings of opening and closing of the first intake valve, the second intake valve, and the outlet valve.

11. The pump of claim 8, wherein the cylinder is a first cylinder and the piston is a first piston, wherein the pump further comprises a second cylinder and a second piston configured to reciprocate within the second cylinder, and wherein the first piston is configured to reciprocate according to a first timing and the second piston is configured to reciprocate according to a second timing different from the first timing.

12. The pump of claim 8, wherein the first intake valve is configured to open and to close during the downstroke of the piston, wherein the second intake valve is configured to open during the downstroke of the piston after, or concurrently with, closing of the first intake valve, and to close during an upstroke of the piston.

13. The pump of claim 8, wherein the outlet valve is configured to open at least for a duration in which the second intake valve is open.

14. A pump system, comprising:

a prime mover;

a camshaft system mechanically coupled to the prime mover; and a pump driven by the prime mover, the pump comprising:

a cylinder defining a bore in fluid communication with a first fluid intake, a second fluid intake, and a fluid outlet;

a piston configured to reciprocate within the bore of the cylinder;

a first intake valve configured to control flow of a first fluid containing proppant through the first fluid intake, the camshaft system configured to cause the first intake valve to open and to close during a downstroke of the piston;

a second intake valve configured to control flow of a second fluid free of proppant through the second fluid intake, the camshaft system configured to cause the second intake valve to open during the downstroke of the piston after, or concurrently with, closing of the first intake valve, and to close during an upstroke of the piston; and an outlet valve configured to control flow of a mixture of the first fluid containing proppant and the second fluid free of proppant through the fluid outlet, the camshaft system configured to cause the outlet valve to open at least for a duration in which the second intake valve is open.

15. The pump system of claim 14, wherein the second fluid free of proppant has a greater pressure than a pressure of the first fluid containing proppant.

16. The pump system of claim 14, wherein the piston is configured to reciprocate within the bore of the cylinder between a top dead center (TDC) position and a bottom dead center (BDC) position, and a middle position of the piston is equidistant from the TDC position and the BDC position, and wherein the camshaft system is configured to cause the first intake valve to open during the downstroke of the piston between the TDC position and the middle position.

17. The pump system of claim 14, wherein the piston is configured to reciprocate within the bore of the cylinder between a top dead center (TDC) position and a bottom dead center (BDC) position, and a middle position of the piston is equidistant from the TDC position and the BDC position, and wherein the camshaft system is configured to cause the first intake valve to close during the downstroke of the piston at approximately the middle position.

18. The pump system of claim 14, wherein the piston is configured to reciprocate within the bore of the cylinder between a top dead center (TDC) position and a bottom dead center (BDC) position, and a middle position of the piston is equidistant from the TDC position and the BDC position, and wherein the camshaft system is configured to cause the second intake valve to close during the upstroke of the piston between the middle position and the TDC position.

19. The pump system of claim 14, wherein the camshaft system is configured to cause the outlet valve to open concurrently with opening of the second intake valve, and wherein the camshaft system is configured to cause the outlet valve to close after, or concurrently with, closing of the second intake valve and before opening of the first intake valve.

* * * * *